US009140276B2

(12) United States Patent
Griffiths et al.

(10) Patent No.: US 9,140,276 B2
(45) Date of Patent: Sep. 22, 2015

(54) LATCHING ACTUATOR

(75) Inventors: Vaughn A. Griffiths, North Logan, UT (US); Michael S. Watson, North Logan, UT (US)

(73) Assignee: Utah State University Research Foundation, North Logan, UT (US)

( * ) Notice: Subject to any disclaimer, the term of this patent is extended or adjusted under 35 U.S.C. 154(b) by 815 days.

(21) Appl. No.: 13/444,754

(22) Filed: Apr. 11, 2012

(65) Prior Publication Data

US 2012/0255290 A1 Oct. 11, 2012

Related U.S. Application Data

(60) Provisional application No. 61/474,173, filed on Apr. 11, 2011.

(51) Int. Cl.
*F15B 21/06* (2006.01)
*F15B 21/02* (2006.01)
*F15B 15/26* (2006.01)

(52) U.S. Cl.
CPC ..... *F15B 15/261* (2013.01); *F15B 21/06* (2013.01)

(58) Field of Classification Search
CPC ..... F15B 21/261; F15B 21/26; F15B 21/06
USPC ..... 60/527; 137/62; 222/390
See application file for complete search history.

(56) References Cited

U.S. PATENT DOCUMENTS 4,759,189 A * 7/1988 Stropkay et al. ..... 60/531
5,025,627 A * 6/1991 Schneider ..... 60/527
5,485,762 A * 1/1996 Rothman ..... 74/501.5 R
6,957,753 B2 * 10/2005 Tani ..... 222/390
7,066,042 B2 * 6/2006 Andrews et al. ..... 74/110
2003/0145667 A1 * 8/2003 Donald et al. ..... 74/89.26
2007/0049479 A1 * 3/2007 Carr ..... 494/23
2009/0143730 A1 * 6/2009 De Polo et al. ..... 604/131

OTHER PUBLICATIONS

2 Way Pilot Diaphragm General Service Solenoid Valves, B/C Valve, May 23, 2001.*

Starsys Research, PP-35055 Resettable High Force Pin Puller, available on http://spacedev.com/uploads/products/src_27.pdf on Apr. 26, 2012.

* cited by examiner

*Primary Examiner* — Ehud Gartenberg
*Assistant Examiner* — Deming Wan

(57) ABSTRACT

A latching actuator capable of repeated operation in a cryogenic, remote, or difficult-to-access environment, capable of enduring many cycles without user intervention or maintenance, capable of latching in a fixed position without consuming additional power, or to operate independent of external environmental conditions. In selected embodiments, a latching actuator may comprise an expansion chamber that houses a working substance capable of undergoing a phase change, a logic mechanism, a biasing assembly, and an output pin. In one embodiment, a wax motor may provide the motive force to toggle a latching mechanism. An actuator may be capable of positioning an output pin in two or more discrete latching positions and may be used to create a thermal connection between two structures, to engage or disengage a clutch, or to position an optical element in an optical instrument. An actuator may also be used as a launch lock apparatus.

18 Claims, 12 Drawing Sheets

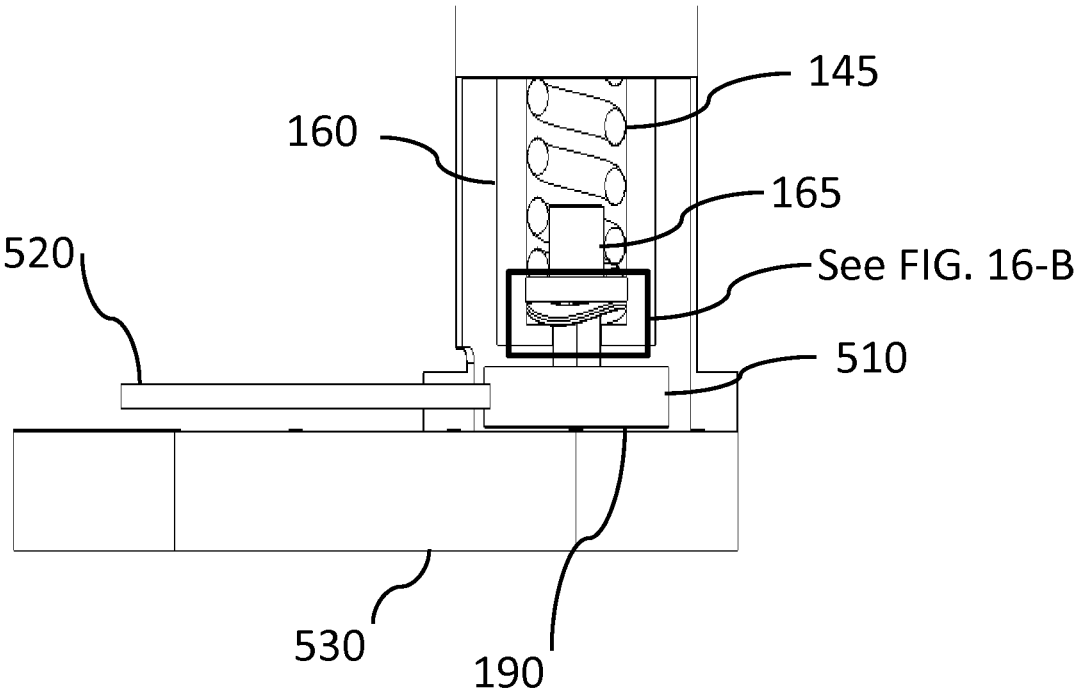
FIG. 16-A
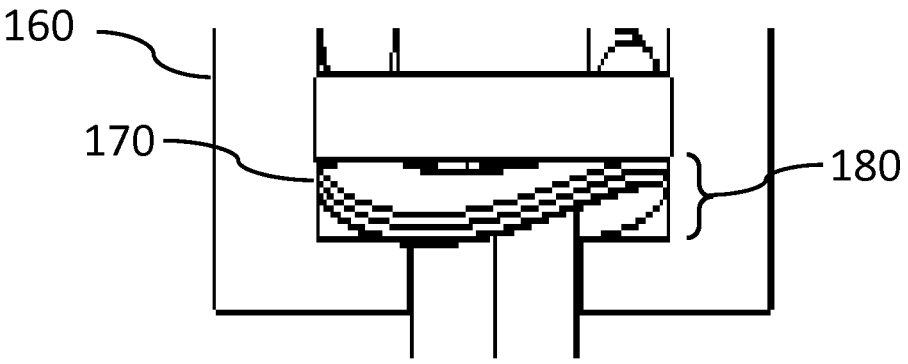
FIG. 16-B

LATCHING ACTUATOR

RELATED APPLICATIONS

This patent application claims the benefit of U.S. Provisional Application 61/474,173, filed Apr. 11, 2011 and entitled CRYOGENIC LATCHING INSTRUMENT COOLER, which is incorporated herein by reference in its entirety.

TECHNICAL FIELD

The present disclosure relates to control systems, more particularly, to novel systems and methods for affecting a latching actuator in a remote or difficult-to-access environment such as a reduced pressure, cryogenic, or outer space environment.

BACKGROUND

Some switch systems capable of operating in a remote environment are currently available. Cunningham et al. (U.S. Pat. No. 4,388,965) disclose an automatic thermal switch that controls heat flow between two thermally conductive plates. In a normally open switch configuration, the environmental temperature to which a first plate is exposed heats the plate. A rise in temperature of the first plate drives a phase-change of ammonia, Freon, or deionized water to a gas inside a power unit which is capable of driving a piston. The increased pressure caused by the phase change motivates the piston to create a thermal path between the first and second plates. The thermal path is maintained so long as the temperature of the first plate is maintained at or above the phase-change temperature of the working substance by the ambient temperature. In a normally closed switch configuration, raising the temperature of one of the thermally conductive plates causes a reaction that breaks a thermal path between the first and second plates.

Applicants filed U.S. Non-Provisional application Ser. No. 11/467,431, on Aug. 25, 2006, entitled APPARATUS, SYSTEM, AND METHOD FOR MODIFYING A THERMAL CONNECTION, which is incorporated herein by reference in its entirety. In that application, Applicants disclosed, inter alia, a wax actuator that could extend and/or retract a plunger to motivate a thermal connector in a cryogenic atmosphere. Applicants learned after filing the application, however, that the anticipated actuator was not available and was incapable of performing the expected functions. Application Ser. No. 11/467,431 was abandoned.

SUMMARY

Applicants have identified the need for a latching actuator capable of repeated operation in a cryogenic, remote, or difficult-to-access environment, capable of enduring many cycles without user intervention or maintenance, or capable of latching in a fixed position without consuming additional power to maintain a latched position or to operate independent of external environmental conditions. The present disclosure in aspects and embodiments addresses these various needs and problems.

A latching actuator may be used in several different applications. In one exemplary application, a latching actuator may be used to create a thermal connection between two structures to transfer heat from one structure to another structure. In another exemplary application, a latching actuator may be used to engage or disengage a clutch. The clutch may be part of a motion transfer system that transfers radial or linear motion between moveable parts of a machine (e.g., a motor and another part of a machine). In another exemplary application, a latching actuator may drive a shutter, lens, mirror, or other optical element in an optical instrument. In yet another exemplary application, a latching actuator may be used to secure moveable components in a device to prevent damage to the components or the device while the device is being transported (e.g., a launch lock apparatus). In this last exemplary use, the latching actuator may be used to secure delicate satellite components while being launched into outer space.

In selected embodiments, a latching actuator may comprise an expansion chamber that houses a working substance capable of undergoing a phase change, a logic mechanism (e.g., latching section), a biasing assembly, and an output pin. In one embodiment, a wax motor may provide a motive force to toggle a latching mechanism.

In still other embodiments, a latching actuator may be capable of positioning an output pin in three or more discrete latching positions. The actuator may cycle an output pin through multiple positions by cyclically actuating a wax motor. Additionally, the latching actuator may be capable of maintaining each latched, discrete position without the need to consume additional energy and may be able to operate independent of external environmental conditions.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 16-A is an elevation view of a portion of a representative latching switch;

FIG. 16-B is a close-up view of a portion of FIG. 16-A;

DETAILED DESCRIPTION

Figure 1:
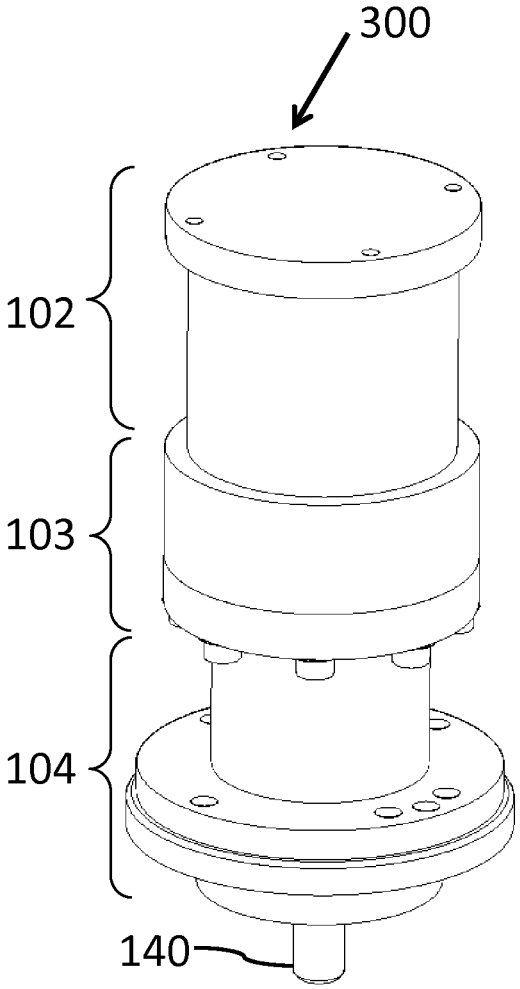
FIG. 1 is an isometric view of a representative latching actuator.

The present disclosure covers apparatuses and associated methods for a latching actuator. In the following description, numerous specific details are provided for a thorough understanding of specific preferred embodiments. However, those skilled in the art will recognize that embodiments can be practiced without one or more of the specific details, or with other methods, components, materials, etc. In some cases, well-known structures, materials, or operations are not shown or described in detail in order to avoid obscuring aspects of the preferred embodiments. Furthermore, the described features, structures, or characteristics may be combined in any suitable manner in a variety of alternative embodiments. Thus, the following more detailed description of the embodiments of the present invention, as illustrated in some aspects in the drawings, is not intended to limit the scope of the invention, but is merely representative of the various embodiments of the invention.

In this specification and the claims that follow, singular forms such as "a," "an," and "the" include plural forms unless the content clearly dictates otherwise. All ranges disclosed herein include, unless specifically indicated, all endpoints and intermediate values. In addition, "optional" or "optionally" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

In some embodiments, a latching actuator may operate in a remote or difficult-to-access environment. A remote environment may be a reduced pressure environment. In one embodiment, the latching actuator is configured to operate in environmental pressures in the range of 101 KPa to 0.0001 μPa, such as from 1 KPA to 0.001 μPa, or from 1 PA to 0.01 μPa. In a specific embodiment, the latching actuator is configured to operate in a vacuum in the range of 1 μPa to 0.01 μPa. A reduced pressure environment may be found in outer space, e.g., within or beyond Earth's mesosphere or thermosphere. A reduced pressure environment may also be found within a vacuum chamber in a terrestrial environment, where re-pressurizing the chamber may be required to gain access to an apparatus within the chamber. Similarly, a latching actuator may operate in a difficult-to-access environment, such as inside a complex machine or on or within an apparatus that itself is in a remote or difficult-to-access environment.

A representative latching actuator may also operate in a cryogenic atmosphere. A cryogenic atmosphere may reach temperatures as low as −150° C. (123 K) or as low as −270° C. (3 K), or possibly even lower temperatures. A cryogenic atmosphere may be found in outer space, e.g., within or beyond Earth's mesosphere or thermosphere. A cryogenic environment may also be found within a vacuum chamber in a terrestrial environment, where warming up and re-pressurizing the chamber may be required to gain access to an apparatus within the chamber.

Alternatively, in some embodiments, a latching actuator may operate at standard or elevated temperature conditions. For example, a latching actuator may operate from 0° C. to 135° C., such as from 10 to 100° C., or from 20 to 80° C., or from 30 to 70° C., or from 40 to 60° C.

As the latching actuator may be configured to operate in difficult-to-access environments or in a cryogenic atmosphere, the latching actuator may also be capable of enduring thousands of repeated cycles without user intervention or maintenance.

In one embodiment, the latching actuator is capable of latching in two or more fixed positions without consuming additional power to maintain the latched, fixed positions. In this sense, "latched" refers to a fixed, pre-determined position that does not consume or require additional energy input to maintain the position.

The latching actuator may also be capable of maintaining a latched position independent of environmental conditions. For example, the latching actuator may adjust from one latched position to another latched position independent of ambient temperature, pressure, or humidity. In this manner, the latching actuator may be capable of operating independent of environmental conditions.

The following examples are illustrative only and are not intended to limit the disclosure in any way.

EXAMPLES

It will be appreciated that several of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

Figure 2:
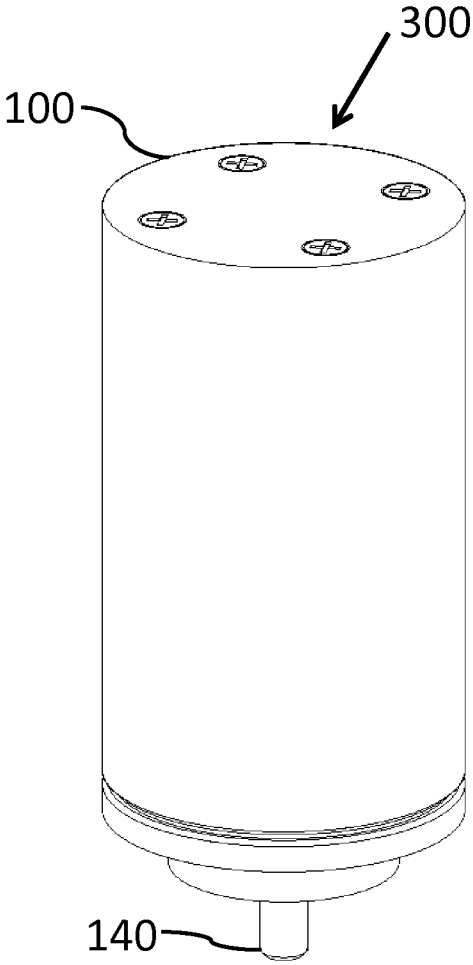
FIG. 2 is an isometric view of the latching actuator of FIG. 1 with a housing.

FIGS. 1 and 2 illustrate through isometric views a representative embodiment of a latching actuator. In selected embodiments, a latching actuator 300 comprises a motor housing assembly 102, a logic mechanism 103, a biasing assembly 104, and an output pin 140. Actuator 300 may also include a housing 100.

Figure 3:
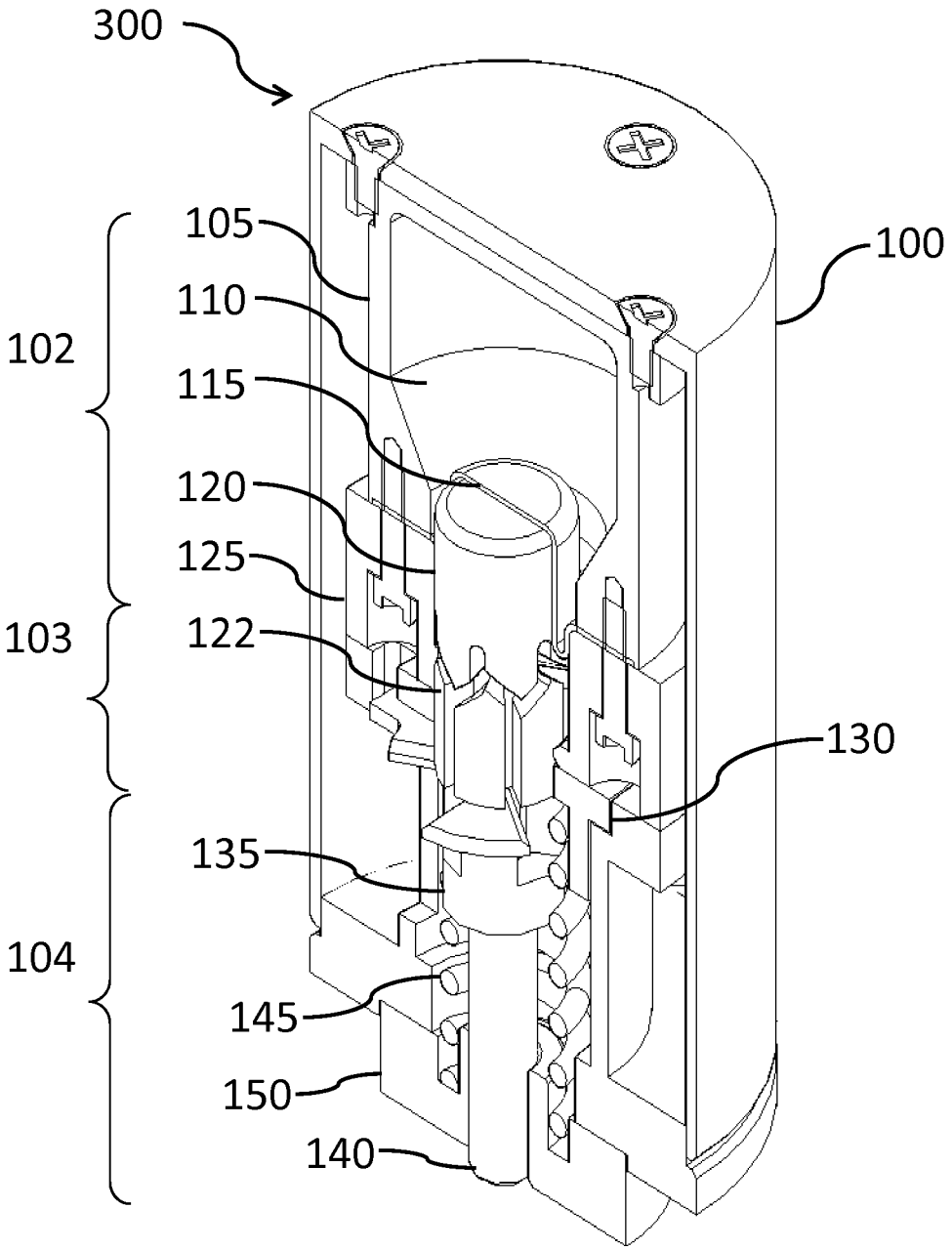
FIG. 3 is a cutaway perspective view of the latching actuator of FIG. 1.

FIG. 3 illustrates a cut-away isometric view of some of the internal components of the representative latching actuator of FIGS. 1 and 2. As shown in FIG. 3, a motor housing assembly 102 comprises an expansion chamber housing 105 that encases an expansion chamber 110. Expansion chamber 110 contains a working substance (not shown) capable of changing phase. Motor housing assembly may also include a diaphragm 115 that encloses an opening in expansion chamber 110.

FIG. 3 also illustrates some of the internal components of a representative logic mechanism 103. Logic mechanism 103 may comprise a latch housing 125, a piston 120, logic channel 122, a rotating latch 130, and an axial latch 135. In addition, FIG. 3 illustrates some of the internal components of biasing assembly 104, which may comprise a reset spring 145, and an alignment bushing 150. Finally, FIG. 3 illustrates output pin 140. For clarity purposes, FIG. 3 illustrates half portions of expansion chamber housing 105, expansion chamber 110, diaphragm 115, latch housing 125, rotating latch 130, reset spring 145, and bushing 150. FIG. 3 further illustrates piston

Figure 4:
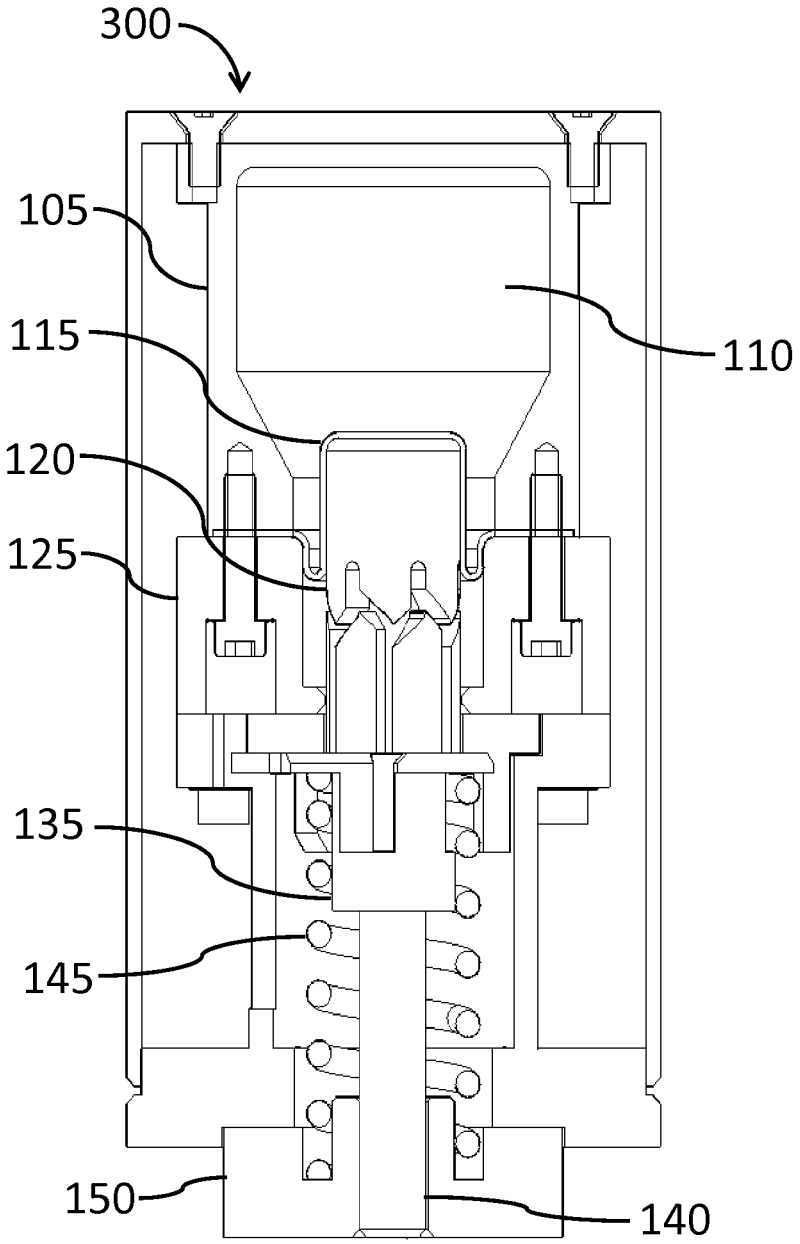
FIG. 4 is cutaway elevation view of the latching actuator of FIG. 1.

120, axial latch 135 and output pin 140 as whole components. FIG. 4 illustrates a cut-away elevation view of the latching actuator of FIG. 1.

Figure 5:
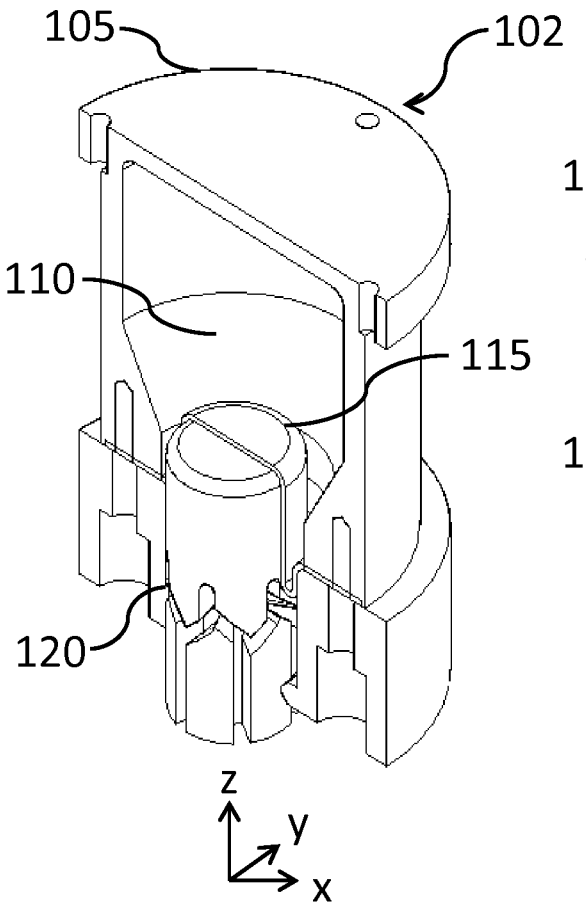
FIG. 5 is a cutaway perspective view of a representative motor assembly of the latching actuator of FIG. 1.
Figure 6:
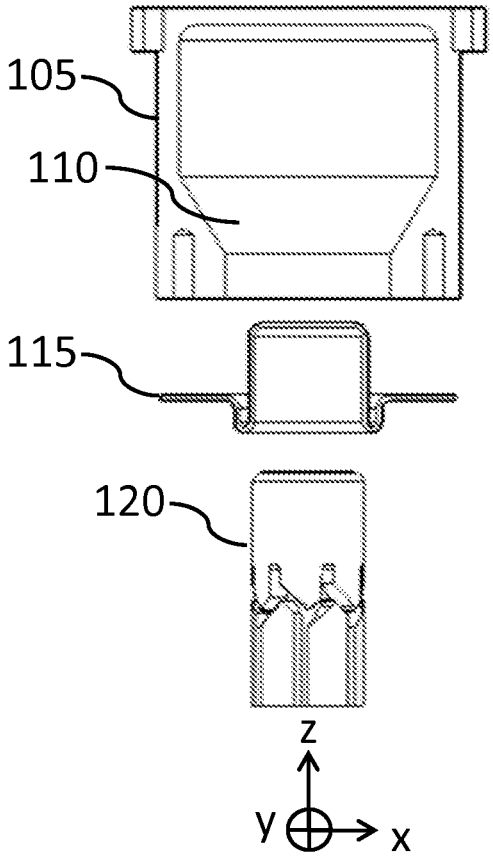
FIG. 6 is an exploded view of the motor assembly of FIG. 5.

FIG. 5 illustrates an isometric cut-away view of motor housing assembly 102, together with some other components. Motor housing assembly 102 may comprise an expansion chamber housing 105 enveloping expansion chamber 110, and diaphragm 115. For clarity purposes in FIG. 5, the expansion chamber housing 105, expansion chamber 110, and diaphragm 115 are shown as being cut in half. FIG. 5 also illustrates piston 120 as a whole component. FIG. 6 illustrates an exploded, plan view of the components of the motor housing assembly of FIG. 5 and piston 120.

Referring to FIG. 5, expansion chamber 110 contains a working substance (not shown) that is capable of changing phase from a solid to a liquid if the temperature of the working substance is at or above a phase change temperature. In the solid phase, the working substance may substantially fill the expansion chamber. As the working substance changes phase from a solid to a liquid, the volume of the working substance will expand. The working substance volume may be constrained by expansion chamber housing 105 on all but one side. The unconstrained opening of expansion chamber housing 105 may be sealed by diaphragm 115. Piston 120 may be adjacent to the opposite side of diaphragm 115. An increase in pressure caused by the expansion of the working substance inside expansion chamber 110 acts to provide a motive force on diaphragm 115 and piston 120 in a downward motion (negative z-direction).

A working substance may be selected based on its ability to melt at a specific temperature (e.g., the phase change temperature) that relates to the operating conditions of the latching actuator. In preferred embodiments, the working substance will melt and expand or solidify and contract at a consistent temperature over many cycles. In a representative embodiment, the working substance is paraffin wax. In one embodiment, the phase change temperature of paraffin wax may be in the range of 17 to 42° C. In another embodiment, the phase change temperature of paraffin wax may be in the range of 80 to 101° C. In another embodiment, the phase change temperature of paraffin wax may be in the range of 105 to 135° C. In yet another embodiment, the phase change temperature of paraffin wax may be in the range of 17 to 135° C.

The ability of the working substance to melt at a specific temperature may be one feature that allows the representative latching actuator to operate independent of environmental conditions. For example, a representative actuator may be able to maintain a latched, discrete position independent of ambient temperature, pressure, or humidity. The actuator may also be able to maintain a latched position without the need to consume additional energy or absorb heat from some source.

The working substance may also be chosen based on its expansion characteristics, which correspond to the amount of displacement that might be created in by the expansion chamber 110 or the motive force on diaphragm 115 and piston 120 when the working substance changes phase from a solid to a liquid. The expansion characteristic of paraffin from a solid to liquid phase may provide the motive force for operating a latching actuator. In some embodiments, paraffin wax may expand anywhere from 9 to 20% by volume as it changes phase. In some embodiments, the volumetric expansion of the working substance corresponds to a motive force of between 220 and 450 Newtons through output pin 140. In some embodiments where the working substance changes phase from a solid to a liquid, as opposed to changing from a liquid to a gas, the motive force on output pin may be much higher, for example as much as 500 or 100 Newtons. In this sense, the motive force caused by the phase change may only be limited by the structural integrity of the volumetric expansion chamber. Alternatively, the volumetric expansion of the working substance may correspond to a motive force from 10 to 50, 50 to 100, or 100 to 200 Newtons.

The size, shape, or volume of expansion chamber 110 may also be modified to provide more or less volumetric expansion of the working substance. The volumetric expansion of the working substance corresponds to the amount of displacement or motive force exerted by the working substance or the distance piston 120 may travel (along the z-axis). Increasing the volume of expansion chamber 110 will provide a greater expansion volume and will allow for an increased motive force or increased travel distance for piston 120. In one embodiment, the volume of the expansion chamber may be less than 3 $cm^3$. Alternatively, the volume of the expansion chamber may be from 3 to 5, 5 to 15, 15 to 30, 30 to 40, or 40 to 50 $cm^3$. In yet another embodiment, the volume of the expansion chamber may be greater than 50 $cm^3$.

Diaphragm 115 comprises a diaphragm material that may be selected based on its ability to withstand repeated cycles in a cryogenic environment without chemical, thermal, or mechanical degradation. In a representative embodiment, diaphragm 220 is a nitrile rolling diaphragm.

To actuate latching actuator 300, the working substance inside expansion chamber 110 may be heated. In selected embodiments, an electrical resistance heater (not shown) may apply heat to the exterior of expansion chamber housing 105. In one embodiment, thin KAPTON heaters adhered to the outside of expansion chamber housing 105 may be used. Expansion of the working substance may force piston 120 toward rotating latch 130. Once the heaters are turned off, the working substance may begin to cool, solidify, and contract. Preloads in reset spring 145 may force piston 120 and diaphragm 115 back into or towards expansion chamber 115.

Any suitable material may be used to make motor housing assembly 102. In selected embodiments, all components in motor housing assembly 102, except for diaphragm 115, may be made of aluminum. Other embodiments may use a material with a larger thermal capacity, thereby maintaining the working substance closest to the diaphragm in the liquid phase during the cooling cycle. This may allow for a more reliable, complete retraction. Additionally, other embodiments may include internal heaters and temperature sensors, thinner walls, and larger diameter diaphragms. Such arrangements may reduce size, increase operating pressure, or improve reliability. In selected embodiment, the geometry or shape of piston 120 may assist in constraining or maintaining the shape of diaphragm 115. Piston 120 may also provide a hard attachment point for other (e.g., lower) components of latching actuator 300.

Figure 7:
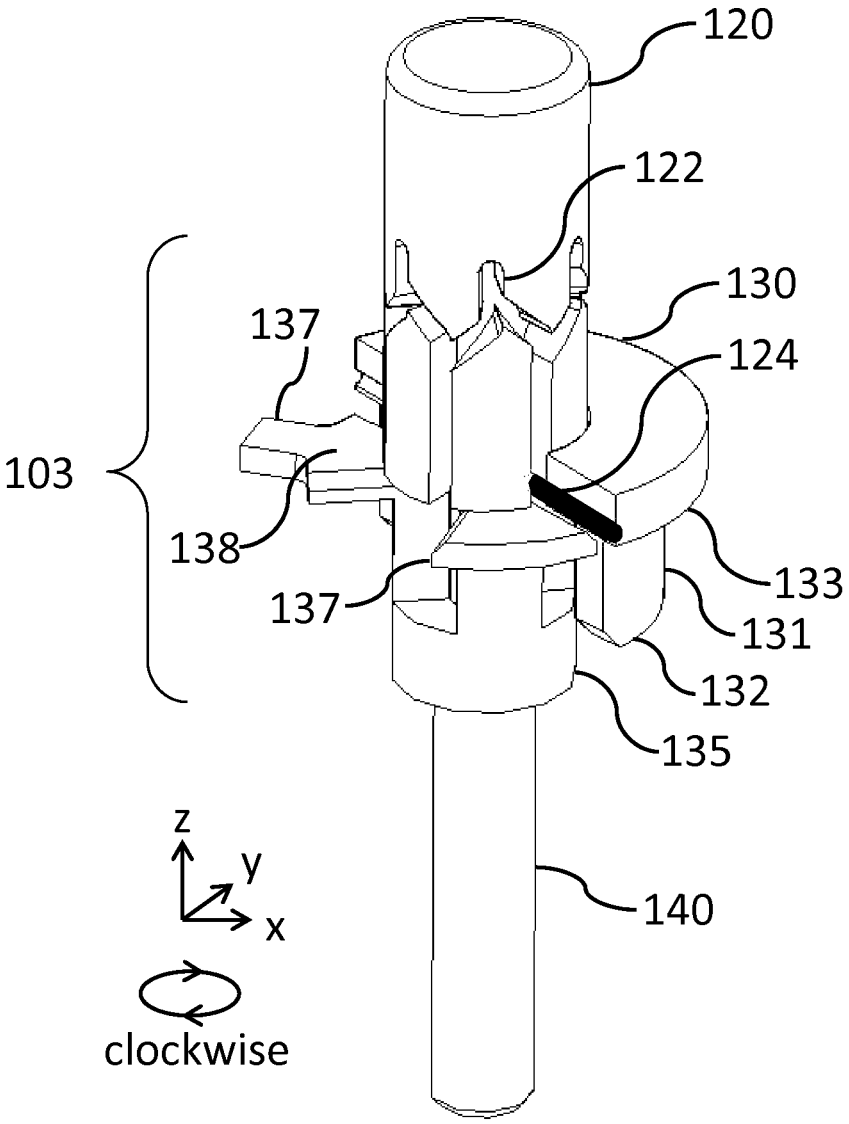
FIG. 7 is an isometric view of a representative logic mechanism of the latching actuator of FIG. 1.
Figure 8:
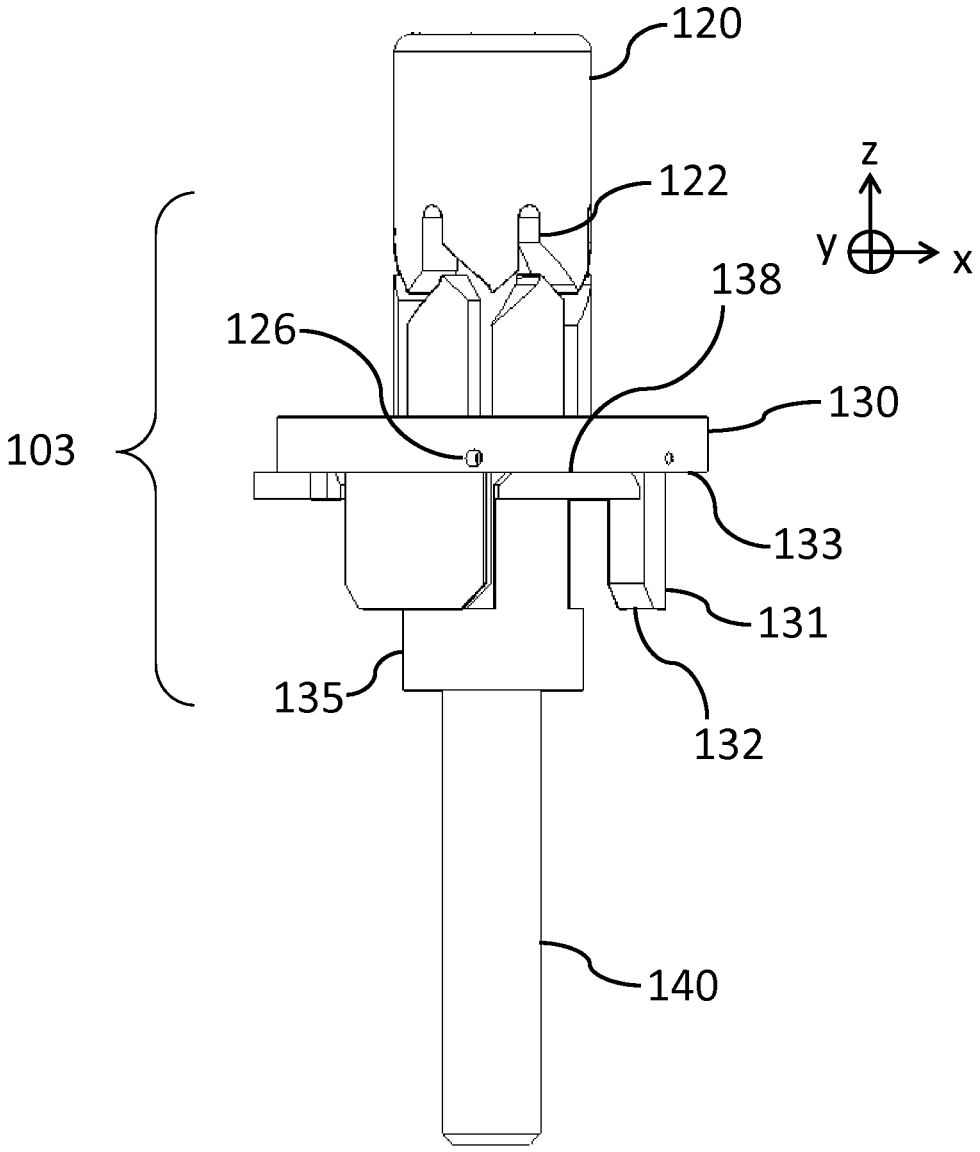
FIG. 8 is an elevation view of a representative logic mechanism of FIG. 7.

FIGS. 7 and 8 illustrate an isometric view and elevation view, respectively, of exemplary logic mechanism 103 in relation to output pin 140. In selected embodiments, logic mechanism 103 may include a piston 120, a logic channel 122 circumscribed into the outside circumference of piston 120, a rotator latch 130, and an axial latch 135. For clarity purposes, FIG. 7 illustrates only half of rotator latch 130, whereas the other elements of logic mechanism 103 are illustrated as whole components.

Rotator latch 130 may comprise a disc that surrounds piston 120 and may be held in place axially relative to the motion of piston 120. Rotator latch 130 may be in housing 100 between two bearings sets (not shown). Accordingly, in such embodiments, the relative motion of rotator latch 130 may be substantially limited to rotation. In selected embodiments, rotator latch 130 further comprises a lower disc surface 133, one or more rotator teeth 131, and one or more logic pins 124. Rotator teeth 131 may also include a lower tooth surface 132. Logic pin 124 may be secured to rotator latch 130 through pin slots 126 (shown in FIG. 8) such that logic pin 124 and rotator latch 130 move radially together (around the z-axis). In selected embodiments, axial latch 135 further comprises axial teeth 137, which have a top tooth surface 138. In this embodiment, piston 120, axial latch 135, and output pin 140 are mechanically connected such that the three components move up and down together (along the z-axis). Logic pins 124 and the sloped surfaces of logic channel 122 form the "logic elements" of logic mechanism 103 as they perform a latch, unlatch, and latch sequence (described below).

Any suitable material may be used to generate logic mechanism 103. In certain embodiments, all materials in this assembly may be aluminum with the exception of logic pins 124 and rotator latch 130 bearings (not shown) which may both be stainless steel. Other embodiments may utilize advanced machining capabilities to miniaturize logic channel 122 and other components. Still other embodiments may omit rotator latch 130 bearings in housing 100 entirely (e.g., form rotator latch 130 out of a wear resistant thermal plastic such as TORLON to further reduce the dynamic friction generated during rotation).

Figure 9:
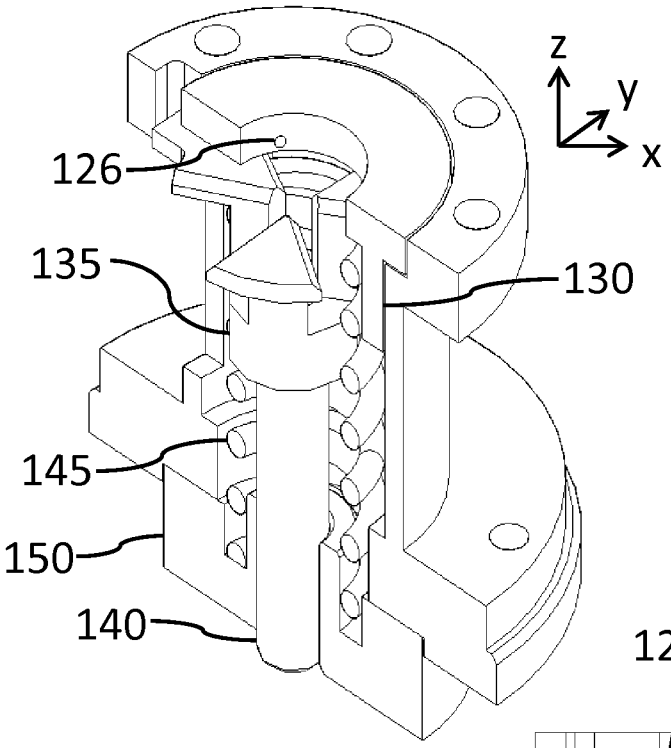
FIG. 9 is an isometric view of a representative biasing assembly of the latching actuator of FIG. 1.
Figure 10:
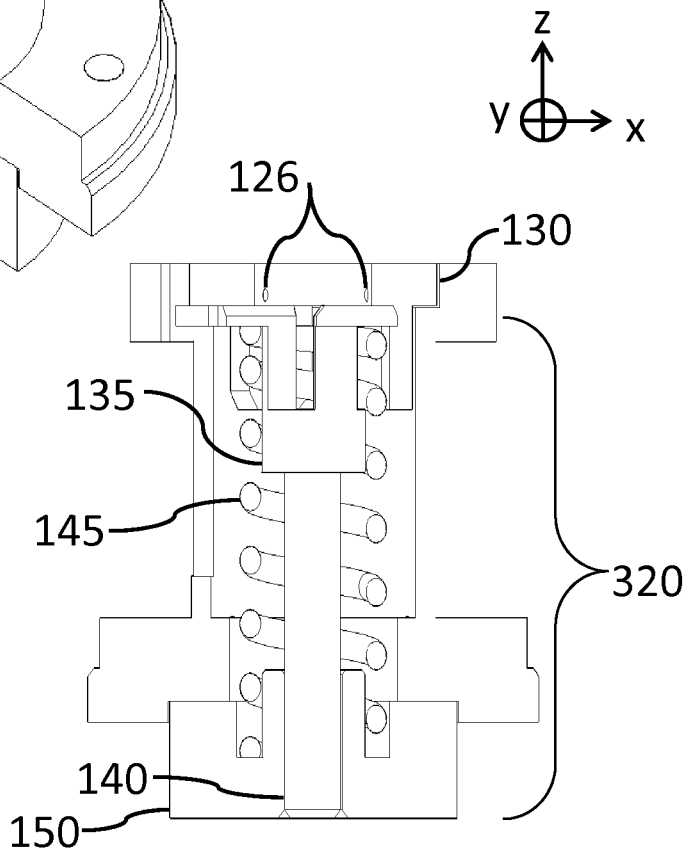
FIG. 10 is an elevation view of a representative biasing assembly of FIG. 9.

FIGS. 9 and 10 illustrate an isometric and elevation view, respectively, of biasing assembly 104 together with axial latch 135 and rotating latch 130. Also shown are pin slots 126. In certain embodiments, biasing assembly 104 comprises reset spring 145 and alignment bushing 150. For clarity purposes, FIG. 9 illustrates axial latch 135 as a whole and other parts as being cut in half. In operation, reset spring 145 biases the top tooth surfaces 138 of axial latch 135 against the lower tooth surface 132 of rotator latch 130 when output pin 140 is in an extended position. Alternatively, as shown in FIGS. 9 and 10, reset spring 145 biases the top tooth surfaces 138 of axial latch 135 against the lower disc surface 133 of rotator latch 130 when output pin 140 is in a retracted position.

Referring back to FIGS. 7 and 8, in selected embodiments, logic mechanism 103 operates from a latched-retracted position to an unlatched position in the following manner: output pin 140 is in a latched-retracted position such that rotator teeth 131 are locked between axial teeth 137 and the top surfaces 138 of axial teeth 137 are biased against lower disc surface 133 of rotator latch 130. In this position, the working substance in expansion chamber 110 is in a contracted, solid phase such that logic mechanism 103 consumes no energy to maintain output pin 140 in this latched-retracted position. Power applied to a heat source (not shown) located on, in, or near expansion chamber 110 (shown in FIG. 4) may cause a working substance in expansion chamber 110 to change from a solid to a liquid phase. As the working substance changes phase from solid to liquid, the working substance expands, driving piston 120, axial latch 135 and output pin 140 in a downward motion (negative z-direction) relative to rotator latch 130 and logic pins 124. As piston 120 moves downward, logic pins 124 travel up towards the top of logic channel 122. As logic pins 124 approach the upper portion of logic channel 122, lower tooth surfaces 132 of rotator teeth 131 become positioned above (along the z-axis) the top tooth surfaces 138 of axial teeth 137. Continued relative downward motion of logic channel 122 circumscribed in the outside diameter of piston 120 may generate rotation of rotator latch 130. In selected embodiments, during this rotation, there may be no axial load on rotator latch 135. As logic pins 124 reach the top of logic channel 122, rotator latch 130 rotates in a clockwise direction relative to axial latch 135. In this unlatched position, the working substance may be in a liquid phase.

Continuing with FIGS. 7 and 8, in selected embodiments, logic mechanism 103 operates from an unlatched position to a latched-extended position in the following manner: as power is turned off from the heat source (not shown), heat will dissipate from the working substance through expansion chamber housing 105 (shown in FIGS. 5 and 6), causing the substance to cool, solidify, and contract. As the working substance contracts, reset spring 145 (shown in FIGS. 9 and 10) will press axial latch 135 and piston 120 in an upward motion (positive z-direction) relative to rotator latch 130 and logic pins 124. As piston 120 moves upward, logic pins 124 travel down logic channel 122. As logic pins 124 continue moving down logic channel 122, rotator latch 130 rotates in a clockwise direction relative to axial latch 135 until rotator teeth 131 are centered above top surface 138 of axial teeth 137. As the working substance continues to cool, solidify and contract, axial latch 135 and piston 120 continue moving upward and logic pins 124 continue traveling down logic channel 122 until lower tooth surface 132 of rotator teeth 131 press against top tooth surface 138 of axial teeth 137. In this position, output pin 140 is in an extended position and the working substance in expansion chamber 110 may be in a contracted, solid phase such that latching actuator 300 consumes no energy to maintain output pin 140 in this latched-extended position.

In certain embodiments, travel of axial latch 135 may be monitored or controlled by an infrared switch (not shown). In selected embodiments, triggering such a switch may interrupt power to heat source on, in, or near motor housing assembly 102 and initiate cool down and retraction. In selected embodiments, a latching system in accordance with the present invention may operate in a high vacuum environment, under cryogenic conditions, endure thousands of cycles, and perform favorably under typical launch vibration loadings.

Figure 11:
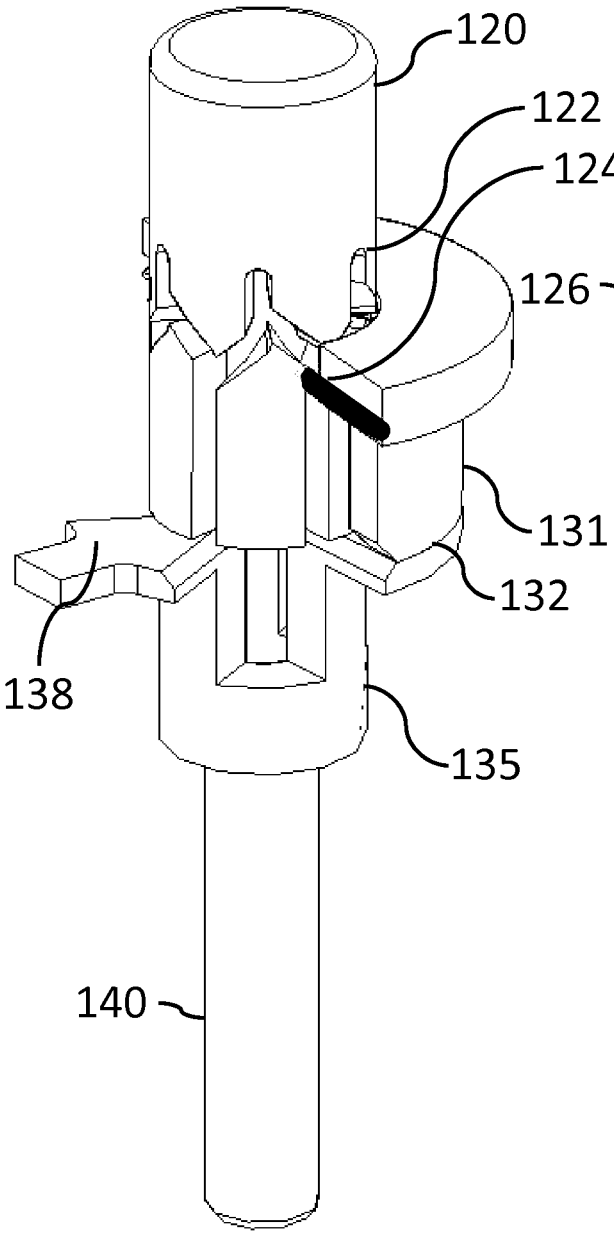
FIG. 11 is an isometric view of a representative logic mechanism of the latching actuator of FIG. 1.
Figure 12:
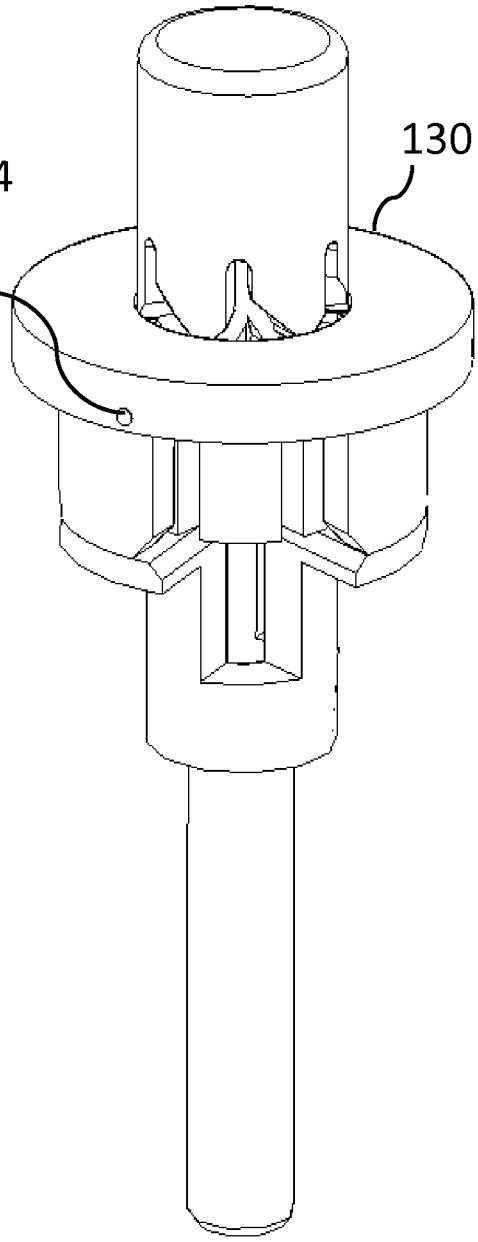
FIG. 12 is an isometric view of a representative logic mechanism of the latching actuator of FIG. 1.
Figure 13:
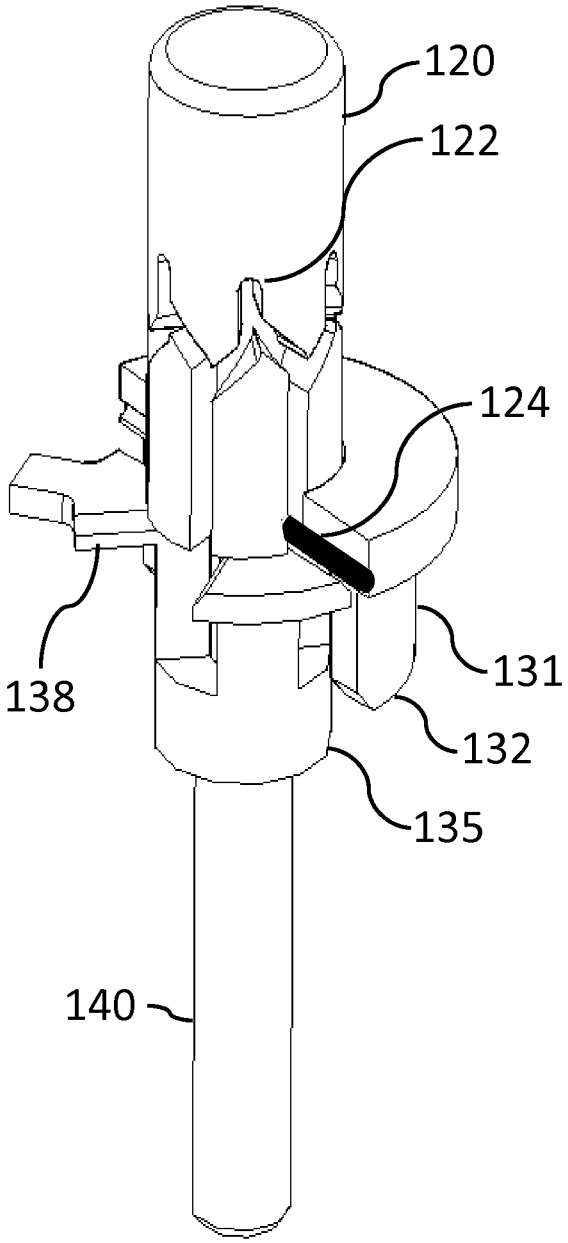
FIG. 13 is an isometric view of a representative logic mechanism of the latching actuator of FIG. 1.
Figure 14:
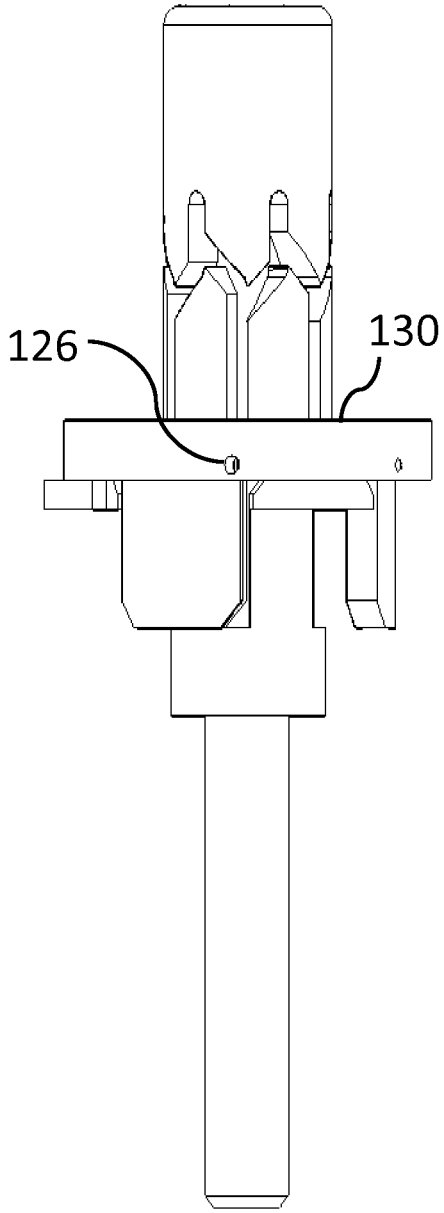
FIG. 14 is an isometric view of a representative logic mechanism of the latching actuator of FIG. 1.

FIGS. 11 and 12 illustrate two isometric views of rotator latch 130 and axial latch 135, together with output pin 140, in an extended-latched position. FIG. 11 illustrates half of rotator latch 130 and shows logic pin 124 whereas FIG. 12 illustrates all of rotator latch 130 and pin slot 126. Similarly, FIGS. 13 and 14 illustrate two isometric views of rotator latch 130 and axial latch 135, together with output pin 140, in a retracted-latched position. FIG. 13 illustrates half of rotator latch 130 and shows logic pin 124 whereas FIG. 14 illustrates all of rotator latch 130 and pin slot 126.

In selected embodiments, some of the logic mechanism elements (e.g., logic pins 124 and logic channel 122) may never be under any substantial static or dynamic system loads. The internal spring pressure generated by reset spring 145 may be removed from the rotator latch 130 prior to any activity on the part of the logic elements. Additionally, static loads generated while in either the latched-extended or latched-retracted position may be supported by rotator latch 130 and axial latch 135, not the logic elements (e.g., logic pins 124 and logic channel 122). Accordingly, in selected embodiments, the only stresses within the logic elements may be generated by the frictional forces within the bearing sets, which may be minimal. Accordingly, a latching system may be formed of relatively small, light components that are able to withstand repeated cycles with minimal wear. In this sense, repeated cycles may refer to more than 1, 10, 100, or even 1000 cycles without the need to replace components or for an operator to reset the positions of components or provide other maintenance to the logic mechanism or its components.

In certain embodiments, the latching actuator may cycle between a latched-extended position to a latched-retraced position in the same manner as described above. For each cycle, rotator latch 130 may rotate sixty degrees. This rotation may align rotator teeth 131 with axial teeth 137 such that rotator teeth 131 are latched on top of or in between axial teeth 137. Subsequent cycles may continue to generate equal rotations, advancing to a latched-retracted configuration or a latched-extended configuration, and so forth. The transitions between a latched-extended and a latched-refracted configuration may be caused by motor housing assembly 102 (e.g., heating of the working substance) and logic mechanism 103 and may operate independent of ambient conditions.

Latching Thermal Link

Figure 15:
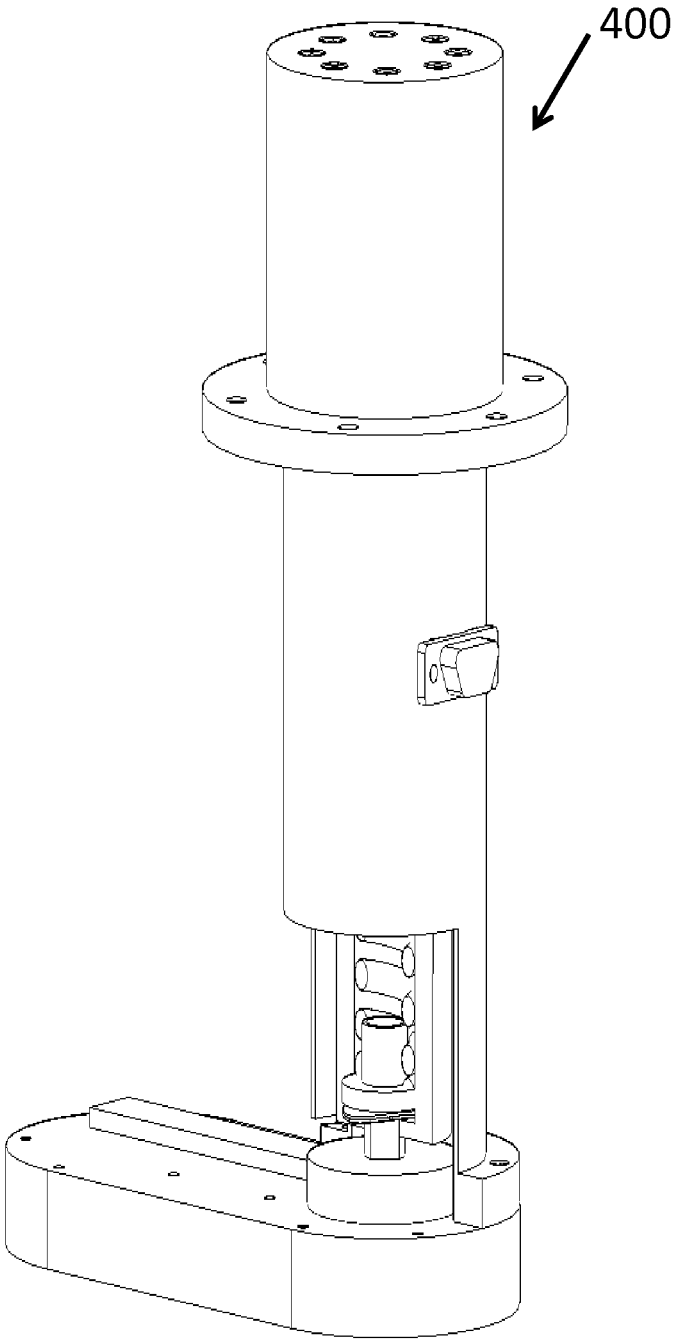
FIG. 15 is an isometric view of a representative latching switch.

In one exemplary embodiment, as shown in FIG. 15, a latching actuator may be used to create a thermal connection between two structures to transfer heat from one structure to another structure. For example, a first end of a thermal link (e.g., a flexible thermal link) may be thermally connected to a first structure. A second end of the thermal link may be positioned proximate or connected to the output piston of a latching system. Through the operation of a latching system, a user may selectively position the second end of the link into contact with a second structure. Accordingly, the latching system may selectively control whether the first structure is thermally connected to the second structure.

Referring to FIG. 16-A, a latching actuator used to create a thermal connection may further comprise a lower housing 160, a reset spring 145, a link plunger 165, and a separation spring 170. Reset spring 145 provides compression between link plunger 165, thermal link end block 510 and thermal sink 530. Link plunger 165 may be mechanically coupled to a thermal link end block 510, which in turn, may be thermally coupled to a flexible thermal link 520. A representative latching actuator may latch thermal link end block 510 against thermal sink 530.

Referring to FIGS. 16-A and 16-B, in a thermal link exemplary embodiment, there may be a gap 180 between link plunger 165 and the floor of lower housing 160. This gap may be filled by separation spring 170. A latching actuator may create a thermal connection between two structures by transitioning from a latched-retracted position to a latched-extended position, thereby closing gap 190 between thermal link end block 510 and thermal sink 530. Accordingly, the transition from a latched-refracted configuration to a latched-extended configuration may include compression of reset spring 145 which effectively compresses separation spring 170 on the underside of link plunger 165 to reduce gap 180 and close gap 190. The latching actuator may require no energy input or an elevated ambient temperature at or above the phase change temperature of a working substance to maintain a latched thermal connection between two structures.

To break the thermal connection between two structures, a latching actuator may transition from a latched-extended position to a latched-retracted position. Separation spring 170 may assist in retracting the mechanism (e.g., link plunger 165) and reproduce the original gap 180. The latching actuator may cycle between a latched-open (latched-retracted position) and a latched-closed (latched-extended) thermal connection many times in a remote, difficult-to-access, high-vacuum, or cryogenic atmosphere without the need for operator intervention or maintenance.

In selected embodiments such as that illustrated, gap 190 may be a relatively small gap (e.g., on the order of 0.5 mm). A latching system may move link plunger 165 a relatively small distance and produce a static latched pressure from about 220 Newtons to about 450 Newtons. Altering the configuration by reducing the size and length of reset spring 145, while increasing the size and length of separation spring 170, may produce a device capable of moving a greater distance, at the expense of reducing latching force.

Multi-Position Latching Actuator

A latching actuator may be configured to operate between two latched positions. In many applications, a latching actuator that operates between two latched positions may be adequate, for example, in closing and opening a thermal link between two structures. A two-position latching actuator may also be sufficient to engage or disengage a clutch, to open and close a shutter in an optical instrument, or to lock and unlock a launch lock apparatus. Alternatively, however, a latching actuator be configured to operate between more than two latched positions. For example, the actuator may be used to position a mirror in three or more latched orientations or positions as part of an optical instrument.

Figure 17:
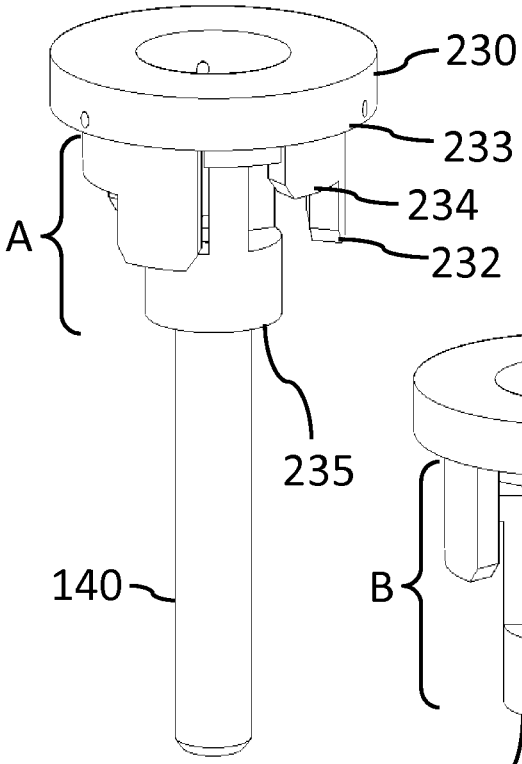
FIG. 17 is an isometric view of a representative logic mechanism.
Figure 18:
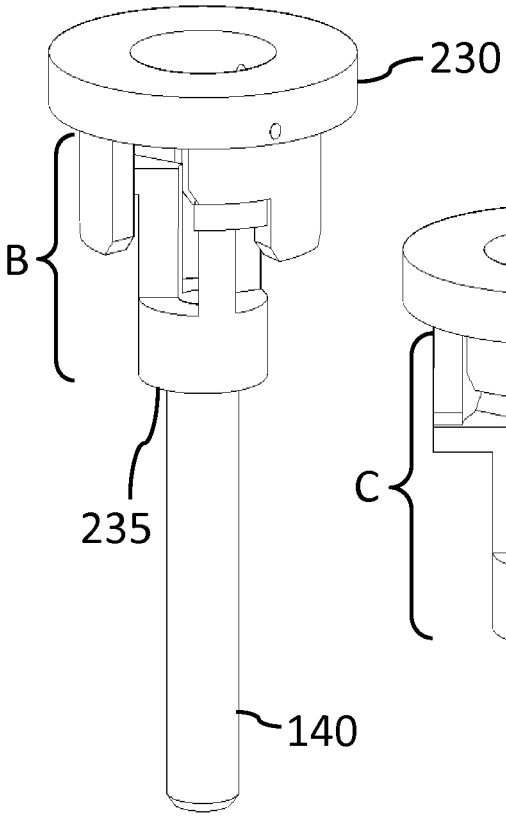
FIG. 18 is an isometric view of a representative logic mechanism.
Figure 19:
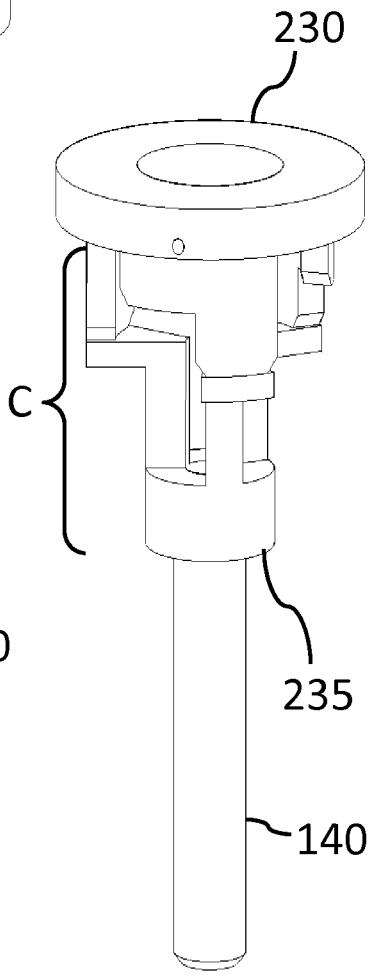
FIG. 19 is an isometric view of a representative logic mechanism.

FIGS. 17, 18, and 19 illustrate isometric views of an alternative rotator latch 230 and axial latch 235 together with output pin 140 positioned in a retracted (labeled "A"), intermediate (labeled "B"), and extended (labeled "C") position, respectively. In this embodiment, rotator latch 230 may include additional teeth elevations to provide an intermediate, or third step height, thereby supporting latching at more than two positions. FIG. 17 illustrates rotator latch 230 with a lower disc surface 233, a lower tooth surface 232, and an intermediate tooth surface 234. FIGS. 18 and 19 illustrate the same rotator latch 230 but the teeth surfaces are not labeled. In comparing FIGS. 17, 18, and 19, FIG. 17 illustrates a latched, fully retracted position where axial latch 235 is positioned against lower disc surface 233 of rotator latch 230; FIG. 18 illustrates a latched, intermediate position where axial latch 235 is positioned against intermediate tooth surface 234; and FIG. 19 illustrates a latched, fully extended position where axial latch 235 is positioned against lower tooth surface 232.

Although FIGS. 17, 18, and 19 illustrate a three-position embodiment of a latching actuator, still other embodiments are envisioned in the present disclosure. By adding teeth with multiple, discrete elevations to a rotator latch, and configuring the logic channel and axial latch accordingly, a latching actuator may latch in as many as four, five, six, or more discrete latching positions. An actuator may cycle through each discrete position by cyclically actuating or heating and cooling motor housing assembly 102. Similarly, latching actuator 300 consumes no energy to maintain output pin 140 in each latched, discrete position and may be able to operate independent of external ambient conditions.

The present invention may be embodied in other specific forms without departing from its spirit or essential characteristics. The described embodiments are to be considered in all respects only as illustrative, and not restrictive. All changes which come within the meaning and range of equivalency of the foregoing description are to be embraced within the scope of the invention.

What is claimed is:

1. A method for actuating a latching actuator, the method comprising:

heating a working substance and changing a phase of the working substance from a solid phase to a liquid phase and moving thereby an output pin from a latched-retracted position to an unlatched position; and cooling the working substance and changing the phase of the working substance from the liquid phase to the solid phase and moving thereby the output pin from the unlatched position to a first latched-extended position.

2. The method of claim 1, further comprising:

heating the working substance and changing the phase of the working substance from the solid phase to the liquid phase and moving thereby the output pin from the first latched-extended position to the unlatched position; and cooling the working substance and changing the phase of the working substance from the liquid phase to the solid phase and moving thereby the output pin from the unlatched position to a second latched-extended position, the second latched-extended position being longer than the first latched-extended position.

3. The method of claim 2, further comprising:

heating the working substance and changing the phase of the working substance from the solid phase to the liquid phase and moving thereby the output pin from the second latched-extended position to the unlatched position; and cooling the working substance and changing the phase of the working substance from the liquid phase to the solid phase and moving thereby the output pin from the unlatched position to the latched-retracted position.

4. The method of claim 1, further comprising:

heating the working substance and changing the phase of the working substance from the solid phase to the liquid phase and moving thereby the output pin from the first latched-extended position to the unlatched position; and cooling the working substance and changing the phase of the working substance from the liquid phase to the solid phase and moving thereby the output pin from the unlatched position to the latched-retracted position.

5. A latching actuator comprising:

a motor housing assembly including a working substance therein capable of changing phase;

a logic mechanism mechanically coupled to the motor housing assembly;

a biasing assembly mechanically coupled to the logic mechanism;

an output pin mechanically coupled to the logic mechanism; and wherein the logic mechanism is configured to latch the output pin in two or more fixed positions independent of an ambient condition and maintain the output pin in the two or more fixed positions without consuming additional energy.

6. The latching actuator of claim 5, wherein the logic mechanism is configured to latch the output pin from a latched-retracted position to a latched-extended position and back to the latched-retracted position through repeated cycles without a need for user intervention.

7. The latching actuator of claim 5, wherein the motor housing assembly comprises:

an expansion chamber housing that encases an expansion chamber and comprises an expansion chamber housing opening; and a diaphragm enclosing the expansion chamber housing opening.

8. The latching actuator of claim 7, wherein the diaphragm comprises a nitrile rolling diaphragm.

9. The latching actuator of claim 7, wherein the working substance comprises a first portion of the working substance adjacent to the diaphragm and a second portion of the working substance positioned a distance away from the diaphragm; and the expansion chamber housing comprises a material with a thermal capacity capable of maintaining the first portion of the working substance in a liquid phase for a longer period of time during a cooling cycle than the second portion of the working substance.

10. The latching actuator of claim 7, further comprising:

a piston that moves in response to a change in pressure within the expansion chamber; and wherein the piston maintains the diaphragm in a shape of the piston.

11. The latching actuator of claim 5, wherein a change in phase of the working substance from a solid phase to a liquid phase creates a motive force of at least 10 Newtons on the output pin.

12. The latching actuator of claim 5, wherein the logic mechanism comprises:

a piston that moves in response to a change in pressure within the motor housing assembly;

a logic channel circumscribed along an outside circumference of the piston;

a rotating latch comprising a disc, the disc defining a hoop encircling the piston;

one or more logic pins mechanically coupled to the disc and configured to penetrate a portion of the logic channel; and an axial latch comprising one or more teeth configured to interface with the rotating latch.

13. The latching actuator of claim 12, wherein the rotating latch comprises a wear-resistant thermal plastic.

14. The latching actuator of claim 12, wherein a relative motion of the rotating latch is substantially limited to rotation.

15. The latching actuator of claim 12, further comprising an infrared switch configured to monitor a movement of the axial latch.

16. The latching actuator of claim 5, wherein the logic mechanism is configured to latch the output pin in three or more fixed positions.

17. The latching actuator of claim 5 wherein the biasing assembly comprises:

a reset spring; and an alignment bushing configured to align the reset spring with the output pin.

18. A thermal coupling system comprising:

a motor housing assembly including a working substance therein capable of changing phase;

a logic mechanism mechanically coupled to the motor housing assembly;

a biasing assembly mechanically coupled to the logic mechanism;

an output pin mechanically coupled to the logic mechanism;

a thermal link end block mechanically coupled to the output pin; and a thermal sink;

wherein the logic mechanism is configured to latch the thermal link both against the thermal sink and a distance from the thermal sink independent of an ambient condition and maintain the thermal link either against the thermal sink or the distance from the thermal sink without consuming additional energy.

* * * * *